US005385199A

United States Patent [19]

Sakaguchi

[11] Patent Number: 5,385,199

[45] Date of Patent: Jan. 31, 1995

[54] MOLTEN METAL SURFACE PROTECTIVE COVER FOR A CONTINUOUS CASTING APPARATUS HAVING MOVING MOLD WALLS

[75] Inventor: Haruo Sakaguchi, Osaka, Japan

[73] Assignee: Hitachi Zosen Corporation, Osaka, Japan

[21] Appl. No.: 252,070

[22] Filed: Jun. 1, 1994

Related U.S. Application Data

[63] Continuation of Ser. No. 14,788, Feb. 8, 1993, abandoned.

[30] Foreign Application Priority Data

Mar. 13, 1992 [JP] Japan ..... 4-54042

[51] Int. Cl.[6] ..... B22D 11/06; B22D 11/10

[52] U.S. Cl. ..... 164/428; 164/430; 164/432

[58] Field of Search ..... 164/428, 480, 430, 431, 164/432, 479, 481

[56] References Cited

U.S. PATENT DOCUMENTS 4,987,949 1/1991 Sakaguchi et al. ..... 164/428 X

FOREIGN PATENT DOCUMENTS 63-177945 7/1988 Japan ..... 164/428
2-34255 2/1990 Japan ..... 164/428
3-66453 3/1991 Japan ..... 164/428
3-221244 9/1991 Japan ..... 164/428
3-297542 12/1991 Japan ..... 164/428

*Primary Examiner*—J. Reed Batten, Jr.
*Attorney, Agent, or Firm*—Joseph W. Farley

[57] ABSTRACT

In a continuous casting apparatus having a pair of moving mold walls between which is defined a molten metal reservoir, the surface of molten metal is covered with an insulating member disposed within the molten metal reservoir. Projecting from opposite sides of the insulating member at locations adjacent the moving mold walls and toward the direction of movement of the mold walls are immersion walls which are immersed into the molten metal. The horizontal distance between the surface of each immersion wall and the surface of the moving mold wall closer thereto is more than 3 mm but not more than 10 mm. The molten metal within the gap between the moving mold wall and the immersion wall steadily flows outward following the movement of the mold wall, and accordingly fresh molten metal flows into the gap and circulates within the gap without stagnation. Therefore, even if slag flows into the gap, the slag positively flows outward without becoming accummulated therein. Thus, the slag is prevented from accumulating within the gap to grow large and from staying in cast metal. This, in turn, prevents the occurrence of cracking in any cast piece produced.

2 Claims, 2 Drawing Sheets

MOLTEN METAL SURFACE PROTECTIVE COVER FOR A CONTINUOUS CASTING APPARATUS HAVING MOVING MOLD WALLS

This is a continuation of copending application Ser. No. 08/014,788 filed Feb. 8, 1993 and now abandoned.

FIELD OF THE INVENTION

The present invention relates to a molten metal surface protective cover in a continuous casting apparatus having moving mold walls.

BACKGROUND OF THE INVENTION

Molten metal surface protective covers of this type have been known which are described in Japanese Patent Application Laid-Open No. 2-41741 and Japanese Patent Application Laid-Open No. 2-220740. In JP laid-open No. 2-41741, a central insulating member is provided which contacts the surface of a middle portion of the molten metal from above in a molten metal reservoir defined between a pair of rolls (an example of moving mold walls). The central insulating member is provided with side insulating members which cover the space above locations adjacent the points of contact between the roll surfaces and the molten metal. Immersion walls concentric with respective roll surfaces project downwardly from side edges of the central insulating member which are formed parallel to the rolls, the immersion walls being spaced a predetermined distance (on the order of 15 to 40 mm) from the roll surfaces.

In JP Laid-Open No. 2-220740, an insulating member floating on the molten metal surface is provided in a molten metal reservoir formed between a pair of rolls. Immersion walls concentric with respective roll surfaces project downwardly from side edges of the insulating member which are formed parallel to the rolls, the immersion walls being spaced a predetermined distance from the roll surfaces.

According to such known arrangement, the molten metal surface is covered with an insulating member and is therefore prevented from becoming oxidized and suffering a decrease in its temperature. The immersion walls at opposite side of the insulating member permit fresh molten metal to flow into the spaces between respective moving mold walls and respective immersion walls. As a consequence, the surface layer of a cast piece shell produced on the surface of each moving mold wall becomes remelted. Thus, the cast piece is prevented from becoming unevenly thick.

However, with such known arrangement, wherein the spacing between each immersion wall and the roll closer thereto is relatively large, flow stagnation may occur on the molten metal surface and, once such stagnation occurs, slag present in the molten metal tends to float up to the surface and gradually accumulate on the molten metal surface to grow into a large mass. Such a grown slag mass may be drawn toward the direction of roll rotation until it forms a part of the cast piece. This slag has poor heat transfer behavior, which results in insufficient cooling of any portion of the cast piece in which such slag is present, eventually leading to cast piece cracking.

SUMMARY OF THE INVENTION

This invention is directed to solving the foregoing problem and accordingly it is a primary object of the invention to provide a continuous casting apparatus, wherein one of process parameters on which a possibility of preventing the occurrence of any flow stagnation between respective immersion walls and respective moving mold walls, such as rolls, is apparently dependent is optimized.

In order to accomplish this object, the invention provides a molten metal surface protective cover for a continuous casting apparatus having a pair of moving mold walls between which is formed a molten metal reservoir, comprising an insulating member disposed in said molten metal reservoir for covering the surface of molten metal, opposite side portions of said insulating member which are formed adjacent said moving mold walls, and immersion walls projecting from the respective side portions toward the direction of movement of the mold walls for immersion into the molten metal, and wherein the horizontal distance between the surface of each immersion wall and the surface of the moving mold wall closer thereto is more than 3 mm but not more than 10 mm.

According to the above arrangement, the surface of the molten metal in the molten metal reservoir is covered with the insulating member and, therefore, the temperature of the molten metal is prevented from decreasing. The immersion walls formed at opposite sides of the insulating member permit fresh molten metal flow into the space between each of the moving mold walls and one of the immersion walls which is closer thereto so that the surface layer of a cast metal shell produced on the surface of the moving mold wall is caused to remelt. Thus, the occurrence of the trouble of uneven thickness with cast metal is prevented.

It has been found that the horizontal distance between the surface of each immersion wall and the surface of the one moving mold wall closer thereto is one of process parameters on which a possibility of preventing the occurrence of any flow stagnation between respective immersion walls and respective moving mold walls is apparently dependent, and that an optimal value of this horizontal distance falls within a range from 3 mm to 10 mm. As far as the value of this horizontal distance falls within this range, the molten metal present. Therefore, the molten metal present between each moving mold wall and the adjacent immersion wall is allowed to steadily flow outward following the movement of the moving mold wall. Accordingly, fresh molten metal flows into the space between the moving mold wall and the immersion wall and molten metal circulates between the moving mold wall and the immersion wall without stagnation. Therefore, even if any slag flows into the space between the moving mold wall and the immersion wall, it flows outward steadily without stagnation. This prevents the trouble of slag accumulating between the moving mold wall and the immersion wall until it grows into a large slag mass. Thus, the presence of large grown slag in cast metal is prevented, and the occurrence of any crack in cast metal produced is also prevented.

DETAILED DESCRIPTION OF THE PREFERRED EMBODIMENT

Figure 1:
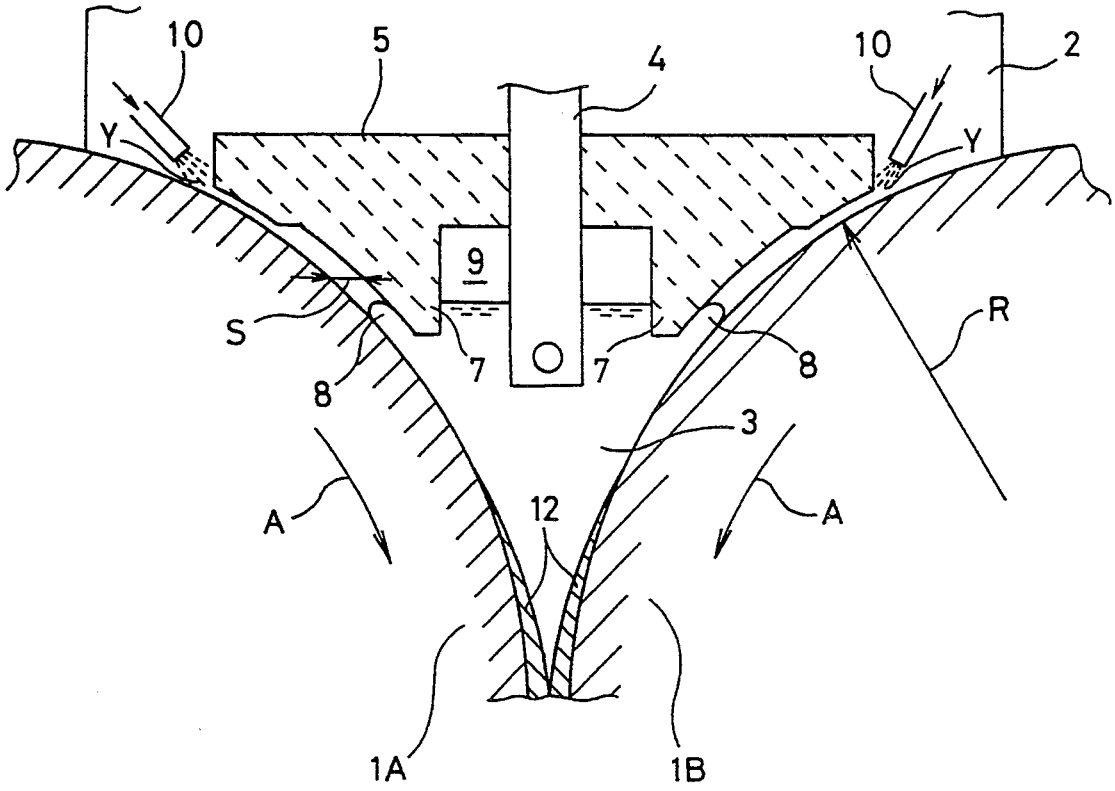
FIG. 1 is a sectional view showing a molten metal surface protective cover representing one embodiment of the invention, in conjunction with moving mold walls and a molten metal reservoir.
Figure 2:
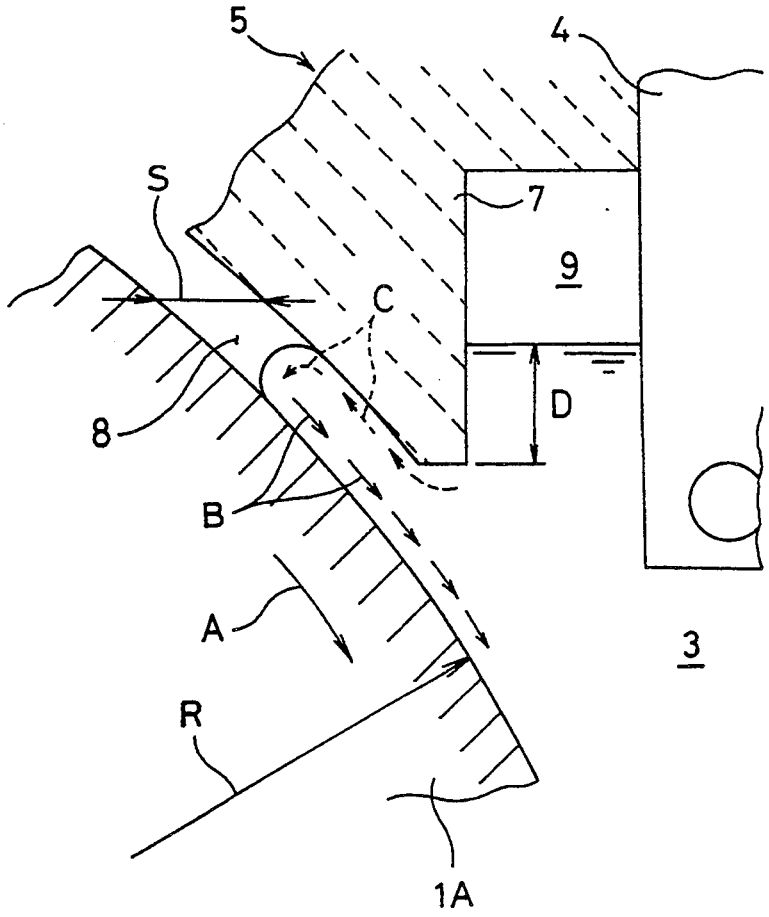
FIG. 2 is an enlarged view showing the immersion walls and moving mold walls seen in FIG. 1.

Referring to FIGS. 1 and 2, reference characters 1A and 1B designate a pair of mold rolls arranged parallel to each other, which are one example of moving mold walls. Between the pair of rolls 1A and 1B is formed a molten metal reservoir 3 by these rolls 1A, 1B in cooperation with a pair of gates 2 disposed on the end side of the rolls 1A, 1B and in contact with the surface of the rolls. The gates 2 may be called short side gates, and in FIG. 1 only one of the gates is partially shown. Shown by numeral 4 is a nozzle which extends downward from a tundish (not shown) in order to guide molten metal from the tundish into the molten metal reservoir 3.

An insulating member 5 for covering the space above the molten metal surface which is rectangular in shape when seen in plan is attached to a lower portion of the pouring nozzle 4. The insulating member 5 has side portions adjacent the respective surfaces of the rolls 1A, 1B. Projecting downwardly from these side portions are immersion walls 7 which are parallel to the respective axes of the rolls 1A, 1B and concentric with the respective surfaces of the rolls 1A, 1B. The immersion walls 7 are triangular in shape in cross section and are immersed into the molten metal. The depth of immersion D of each immersion wall 7 is preferably 3 to 20 mm. The surface of each immersion wall 7 is positioned along the surface of roll 1A, 1B, and the horizontal spacing S between these surfaces is predetermined to be more than 3 mm but not more than 10 mm.

In order to prevent air from being drawn into molten metal from the gap Y between each roll 1A, 1B and the insulating member 5, an inert gas supply nozzle 10 is disposed for blowing an inert gas, such as $N_2$ gas or Ar gas, into the gap Y. The insulating member 5 is provided with an electromagnetic eddy current proximity sensor (not shown) for detecting the position of the molten metal surface.

The function of the above described arrangement will now be explained.

When casting operation is initiated, contact between the molten metal surface and air is severed because the entire surface of the molten metal is covered with the insulating member 5 and, at same time, a decrease in the temperature of the molten metal is prevented. Inert gas is supplied from the inert gas nozzle 10 into the gap Y between the insulating member 5 and roll 1A, 1B and thus the molten metal is prevented from becoming oxidized.

As the rolls 1A, 1B rotate in the direction of the arrow A, cast metal shells 12 produced on these rolls 1A, 1B move downward and, following this movement, molten metal adjacent the shells likewise moves downward because of its viscosity. In this case, the molten metal present in the gap 8 between each immersion wall 7 and roll 1A, 1B positively flows downward as indicated by the arrow B, since the spacing S between the surface of the immersion wall 7 and the surface of roll 1A, 1B is set relatively small, or more than 3 mm but not more than 10 mm. Accordingly, in order to compensate for the molten metal that has flowed outward, fresh molten metal flows into the gap 8 travelling along the immersion wall 7, as indicated by the broken line arrow C.

As a consequence, molten metal circulates within the gap 8 without stagnation and, even if any slag flows into the gap 8, the slag will flow downward from the gap 8 without stagnation. As shown, molten metal currents flowing in opposite directions occur within the gap 8 and a turbulence zone is created along a border line of the opposite directional flows. This turbulence and the quantity of heat of fresh molten metal act in combination to permit remelting of the surface of a cast metal shell 12 formed on the surface of roll 1A, 1B. Thus, the trouble of uneven thickness with the cast metal shell 12 produced on the surface of roll 1A, 1B is eliminated.

It is noted that by providing a space 9 between the insulating member 5 and the molten metal surface detected by the electromagnetic eddy current proximity sensor (not shown), it is possible to absorb some part of any change caused to the position of the molten metal surface by virtue of the space 9. As a result, possible changes in the level of the molten metal in the gap 8 can be minimized, which permits satisfactory casting operation. An inert gas, such as $N_2$ gas or Ar gas, is injected into the gap 9.

One example will be given. Five tons of molten steel corresponding to a variety of SUS304 were cast into a cast piece of 1 m in width, with a target thickness of 3 mm, by employing a pair of rolls 1A, 1B, having a radius of 600 mm. Where the spacing S is set at 5 mm, and at 7 mm, there occurred no crack-like defect. Where the spacing S is set at 15 to 20 mm, a crack of 0.5 to 3 $m/m^2$ did occur. Where the spacing S was set at 2 mm, the spacing was too small to allow sufficient flow of molten metal into the gap 8 and, therefore, casting operation could not be continued. This proved that a spacing S of more than 3 mm but not more than 10 mm is suitable.

In the foregoing embodiment, the gates 2 go into sliding contact with side surface of the rolls 1A, 1B from sides. Alternatively, it may be arranged that the gates 2 come into slide contact with the rolls 1A, 1B from above at top-end side thereof. In the embodiment, the moving mold walls are of the twin roll type. It is understood, however, the molten metal surface protective cover of the invention is also applicable to any continuous casting apparatus having moving mold walls of the belt type or caterpillar type.

What is claimed is:

1. A continuous casting apparatus comprising a pair of moving mold walls between which is formed a molten metal reservoir, an insulating member disposed in said molten metal reservoir, said insulating member having a lower portion covering the surface of molten metal, said insulating member having opposite side portions formed adjacent said moving mold walls, and immersion walls projecting from the respective side portions toward the direction of movement of the mold walls for immersion into the molten metal.

2. A continuous casting apparatus according to claim 1 wherein said lower portion of said insulating member being provided with a space between said lower portion and said surface of said molten metal, said space absorbing at least in part any change in the position of said surface of said molten metal, wherein a horizontal distance between the surface of each immersion wall and the surface of the moving mold wall closer thereto is set at an optimum value of more than 3 mm but not more than 10 mm.

* * * * *